United States Patent [19]

Dahl

[11] 4,043,276

[45] Aug. 23, 1977

[54] SORTING TABLE ARRANGEMENT

[76] Inventor: Robert M. Dahl, 633 Park Ave., Wilmette, Ill. 60091

[21] Appl. No.: 742,594

[22] Filed: Nov. 17, 1976

[51] Int. Cl.[2] ..... A47B 11/00

[52] U.S. Cl. ..... 108/28; 108/94; 108/150; 211/11

[58] Field of Search ..... 108/28, 92, 94, 102, 108/104, 150; 211/10, 11; 312/197

[56] References Cited

U.S. PATENT DOCUMENTS

| | | | |
|---|---|---|---|
| 3,056,506 | 10/1962 | Fuller et al. | 211/10 X |
| 3,245,545 | 4/1966 | Lortie | 108/104 X |
| 3,789,778 | 2/1974 | Brand | 108/94 |
| 3,966,050 | 6/1976 | Dahl | 108/102 X |
| 3,993,375 | 11/1976 | Potter | 108/94 X |

*Primary Examiner*—Roy D. Frazier
*Assistant Examiner*—Darrell Marquette
*Attorney, Agent, or Firm*—Edward L. Benno

[57] ABSTRACT

A sorting table arrangement for use by a seated person to sort paper-like items. The table arrangement comprises the unitary assembly of a circular rotatable table top member and a certain fixed table top member both of which are mounted on a unitary base assembly in cooperation with each other for sorting operations of paper-like items by a person seated on one side of the arrangement.

10 Claims, 5 Drawing Figures

SORTING TABLE ARRANGEMENT

BACKGROUND OF THE INVENTION

Many table arrangements are known in the art for use by a seated person to sort papers. Further, rotatable tables carrying various types of paper sorting aids are also known in the art. In most prior art arrangements paper sorting equipment is provided in the form of different components which are selectively arranged by a person in various combinations to permit or provide for relatively convenient paper sorting operations by a selected person.

SUMMARY OF THE INVENTION

As opposed to known prior art paper sorting table arrangements, the subject invention comprises a particular unitary assembly of certain table components arranged to uniquely present one substantially ideal paper sorting arrangement for a person seated on one side of the arrangement.

The combination of the invention in one preferred embodiment comprises a substantially flat floor base with two spaced apart posts upstanding from the base. On the upper end of one of the posts a circular table top member is rotatively mounted at a normal table top height. On the upper end of the other post a substantially quadrilateral table top member of a preferred configuration is fixedly mounted. The fixed table top member is disposed at a lower height than the circular table top member but above the height of a seated person's lap. One end of the fixed table top member extends beneath the ciruclar table top member.

In a preferred embodiment the circular table top member is provided with a ring of overlapping paper sorting dividers. One end of each of the dividers is hingedly secured to the upper surface of the circular table top member.

The edge of the quadrilateral table top member before which a person is seated is disposed substantially along a line parallel to a radius line of the circular table top member.

A convenient arrangement of a preferred embodiment of the invention for a right handed person is one in which the right arm of the seated person is over the quadrilateral table top member while the left arm is over the circular table top member. In that arrangement the dividers are disposed so that the hinged end of each divider is positioned in a clockwise direction from the other free end thereof when viewed from above the circular table top member.

The primary object of the present invention is to provide a sorting table arrangement for the sorting of paper-like items by a person seated on one side of the table arrangement which will enable the person to easily, conveniently and without tiring sort paper-like items between a fixed table surface and a rotating divider-provided table surface.

Other objects and features of the invention will be apparent upon a perusal of the detailed description read in conjunction with the drawings.

DETAILED DESCRIPTION OF THE PREFERRED EMBODIMENTS

Figure 1:
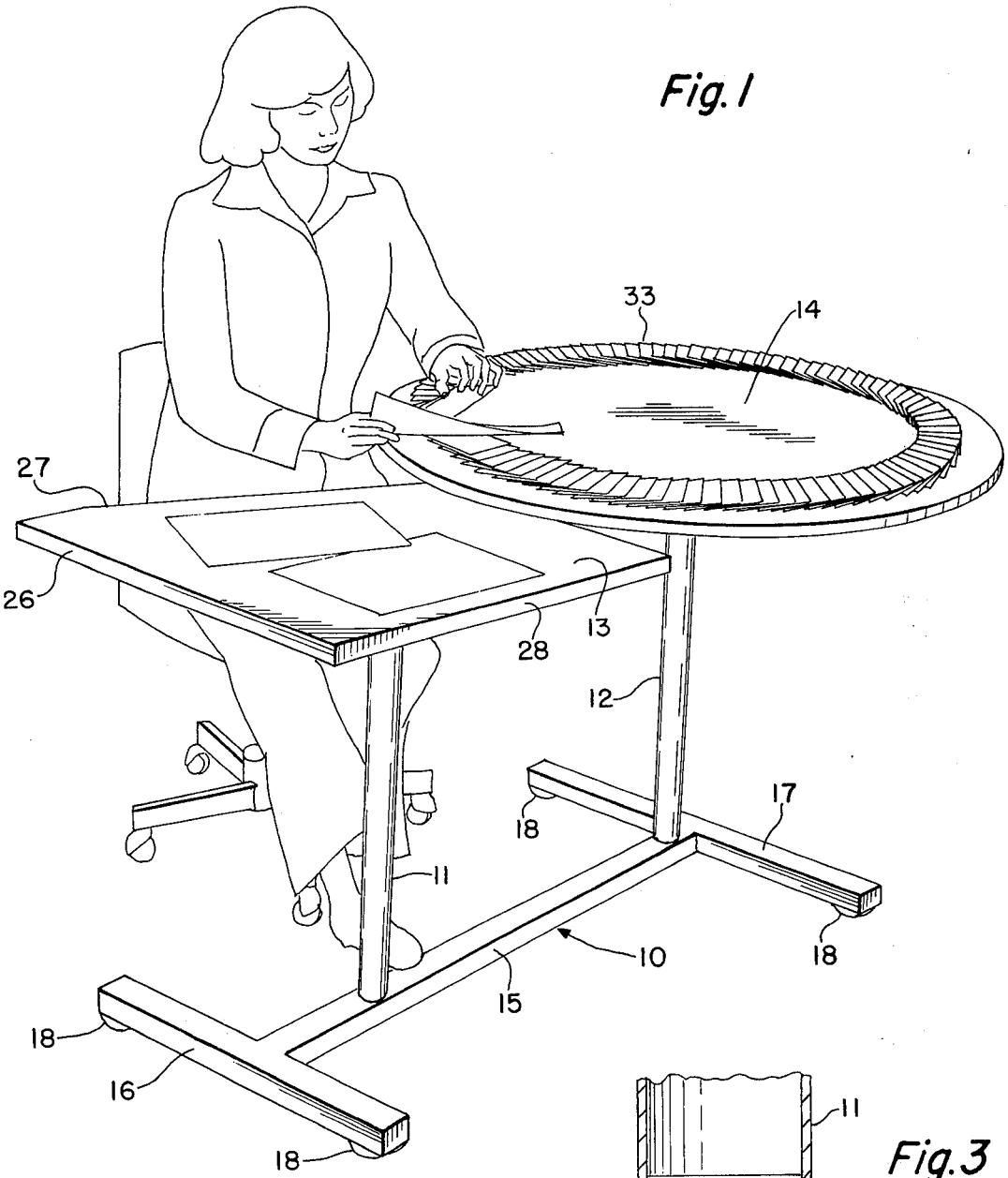
FIG. 1. is a perspective view of one embodiment of the invention and showing a person using the embodiment shown.

In the embodiments shown in the drawings, the sorting table arrangement of the subject invention comprises a base platform 10, two posts 11 and 12, a fixed table top member 13, and a rotatable circular table top member 14.

The base platform 10 lies substantially in a horizontal plane to provide a minimum of disturbance to a person's feet while seated at the table arrangement. Preferably the base plaform 10 comprises an elongated member 15 and two leg members 16 and 17 integrally interconnected with one end of the elongated member 15 connected intermediate the ends of the leg member 16 and with the other end of the elongated member 15 connected intermediate the ends of the leg member 17. The base platform 15 may be made of steel box channel members welded together as shown. Short floor pads 18 are secured to the underside ends of the leg members 16 and 17. The base platform 10 supports the posts 11 and 12 and the table top members 13 and 14 as a unitary assembly. The preferred lengths of the elongaged member 15 and the leg members 16 and 17 are described below in relation to the other parts of the table arrangement.

Figure 3:
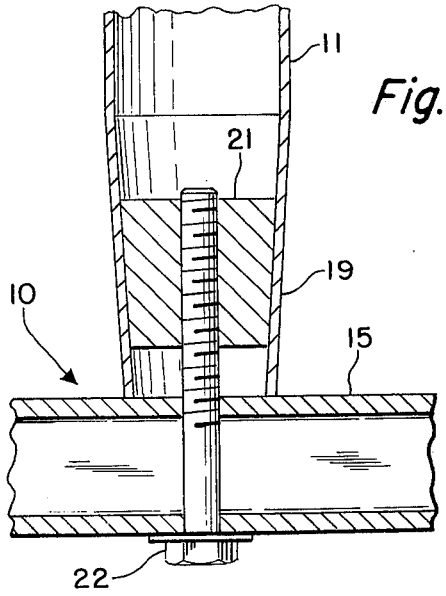
FIG. 3 is an enlarged cross sectional view of one embodiment of a construction for securing posts of the table arrangement of FIG. 1 to the base platform thereof.
Figure 5:
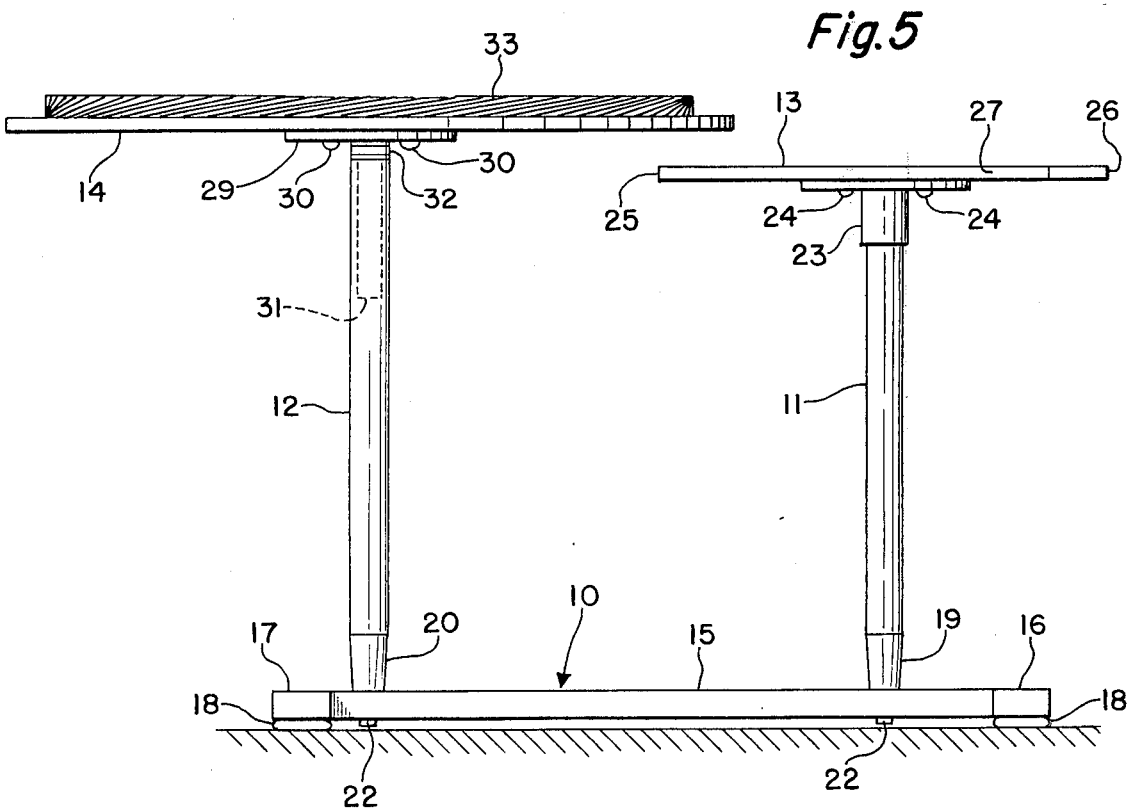
FIG. 5 is a side elevational view of the construction of FIG. 4.

In a preferred form of construction, the posts 11 and 12 are made of tubular steel and the lower ends thereof at 19 and 20 respectively as shown in FIG. 5, are slightly tapered radially inwardly to the lower edges thereof. A steel block such as block 21 shown in cross section in FIG. 3 is provided for each post 11 and 12. The blocks 21 are formed with a side wall taper complementary to the internal wall taper of the ends 19 and 20 a short distance upwardly from the lower edges thereof. The blocks 21 are further provided with a threaded hole extending axially therethrough. With each block 21 inserted into its post 11 and 12 from the upper end thereof, the post are positioned over appropriate vertically aligned holes throught the elongated member 15 and appropriate bolts such as bolt 22 shown in FIG. 3 are inserted through the elongated member 15 from the underside thereof and threaded into the blocks 21. The lower edges of the posts 11 and 12 should have an accurate surface perpendicular to the longitudinal axes of the posts 11 and 12 so that as the bolts 22 are tightened the lower edges of the posts 11 and 12 will be firmly secured to the upper surface of the elongated member 15 with the posts 11 and 12 perpendicular to the elongated member 15.

The fixed table top member 13 is fixedly secured to the upper end of post 11. Table top member 13 is formed in the shape of a substantial quadrilateral from a suitable sheet material such as plywood or some other known processed wood fiber board. Preferably, the upper surface and side edges are covered with a known decorative covering or finish. In one embodiment, a post flange 23 is secured to the underside of the table top member 13 by suitable fasteners 24 at a position that the intersection of diagonal lines drawn between opposite corners of the table top member 13 lies approximately on or near the axis of the depending post sleeve of the post flange 23. The post sleeve of the post flange 23 is telescopically mounted over the upper end of the post 11 and secured thereto such as by welding.

Figure 4:
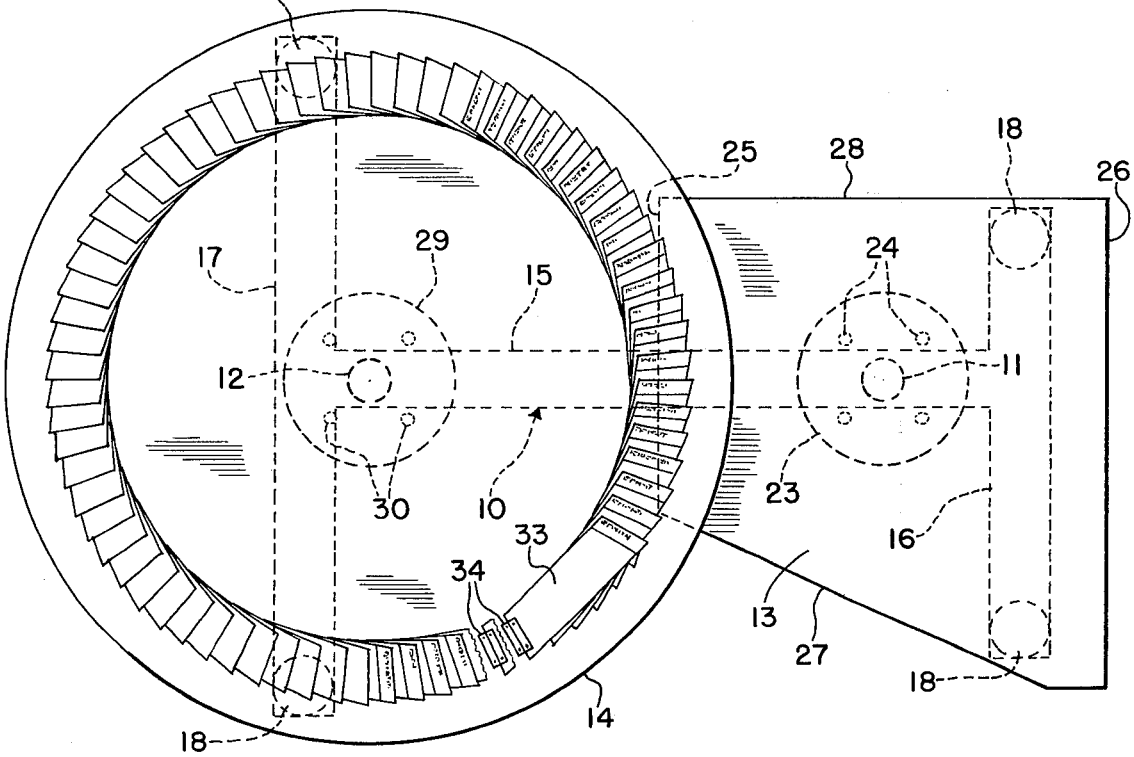
FIG. 4 is a top plan view of the table arrangement of FIG. 1.

The table top member 13 is shaped with the two opposed edges 25 and 26 substantially parallel to each other and perpendicular to the longitudinal axis of the elongated member 15 of the base platform 10. Edge 27 of table top member 13 extends between one end of each of edges 25 and 26, and edge 27 is disposed substantially along a line that includes the vertical axis of post 12 for table top member 14. The junction corners of the edges 25 and 26 with the edge 27 and with the other edge 28 may be rounded or cut off as shown in FIG. 4 at the junction of edged 26 and 27. Preferably, the edge 28 is disposed perpendicular to edges 25 and 26. Edge 27 of table top member 13 is the edge before which the person, using the table arrangement of the described embodiment, sits as shown in FIG. 1. Further in that arrangement as shown in FIG. 4, the leg member 16 of the base platform 10 is disposed perpendicular to the longitudinal axis of elongated member 15, is immediately between vertical planes including the edges 27 and 28, and is further adjacent a vertical plane including edge 26. That arrangement provides a firm support for the table top member 13 and comfortable, convenient non-obstructed working access to the table top member 13 by a person seated before edge 27.

The table top member 14 is circular in shape and substantially larger in area than table top member 13. FIG. 4 displays a good preferred relationship between the areas of the table top members 13 and 14. In a preferred arrangement, the table top member 14 is constructed of the same material as the table top member 13.

At the center underside of the table top member 14 a bracket 29 is secured by appropriate known fasteners 30. The bracket 29 carries any suitable known bearing means for rotatably mounting the table top member 14 on the upper end of the post 12. As shown in FIG. 5, the bracket 29 may be provided with a fixed depending short post 31 journaled into the upper end of the post 12. A ball or roller bearing assembly 32 is mounted about the short post 31 and between the upper edge of the post 12 and the bracket to rotatably carry the table top member 14 on the post 12.

As may be seen in the drawings, the table top member 14 overlaps the table top member 13 so that the edge 25 of table top member 13 lies on a chord of the circle of table top member 14. Preferably, table top member 14 also is positioned in a plane sufficiently above the plane of table top member 13 so that a person's fingers or hand can not easily be pinched or wedged between the two table top members.

The heights of table top members 13 and 14 from the base platform 10 are such that they will extend over the lap of a person seated before the table arrangement, but yet not be so high that a person's forearm can not be placed upon table top member 14 such as shown in FIG. 1.

To provide maximum stability for the unitary table arrangement, leg member 17 of the base plaform 10 has a length slightly shorter than the diameter of table top member 14 and is connected to elongated member 15 close to post 12 with the longitudinal axis of leg member 17 substantially perpendicular to the longitudinal axis of elongated member 15.

The upper surface of table top member 14 is provided with a ring of sorting dividers 33. The ring of dividers 33 are arranged in a circle concentrically within the circular edge of table top member 14. The dividers 33 may have any suitable known form. In the embodiment shown, each divider 33 comprises an elongated card and one end of the card is hingedly secured to the table top member 14 by a hinge 34. As arranged, the dividers 33 overlap each other about the upper surface of the table top member 14. The free exposed end of each divider 33 is provided with any desired legend or indicia tab to indicate a sorting pattern for the papers or paper-like items to be sorted by the person seated before the table arrangement.

For a person seated before the embodiment described above, the dividers 33 are arranged to overlap in a direction such that the hinged end of each divider 33 is disposed clockwise of its free end when viewed from the top of the table arrangement.

Figure 2:
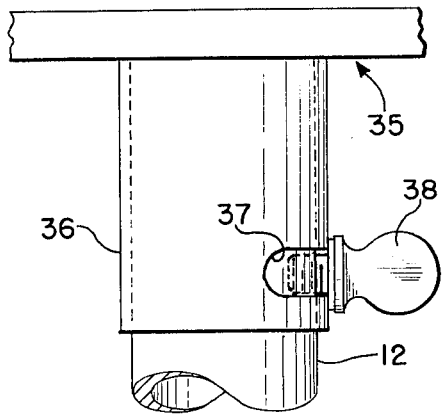
FIG. 2 is an enlarged side elevational view of one embodiment of a construction for adjustably carrying the fixed table top member of FIG. 1.

The invention contemplates that for the further comfort of any particular person using the described table arrangement, the table top number 13 may be made rotatable within a limited range. Such a modification is shown by way of example in the fragmentary view in FIG. 2. As shown, a post flange 35 is substituted for post flange 23. Post flange 35 has a depending sleeve 36 that is journaled over the upper end of post 12. Sleeve 36 is provided with an arcuate slot 37 extending a limited distance circumferentially thereof. A thumb screw 38 is disposed through the slot 37 and threaded into the post 12. By loosening the thumb screw 38 a person using the table arrangement may pivot the table top member 13 through a limited range to pivot the edge 27 through a limited range on each side of the previously described alignment of edge 27 on a radius of the circle of table top member 14. As many persons who spend long hours at paper sorting processes find the alignment of working surfaces critical to their comfort and efficiency, the limited adjustability of table top member 13 to table top member 14 can be helpful.

It should be understood, that if desired the described embodiments can be reversed in construction so that the person's position is reversed from that shown in FIG. 1, and the person sits before edge 27 where edge 28 is shown and the right arm of the person is over table top member 14.

The invention contemplates a further embodiment where the range of adjustability of slot 37 permits edge 28 of table top member 13 to be aligned substantially on a radius of the circle of table top member 14. The person would then be seated before edge 28 of the table arrangement and the dividers 33 would preferably be caused to overlap in the opposite direction from that described above.

Having described the invention, it is to be understood that changes can be made in the described embodiments by a person skilled in the art within the spirit and scope of the claims.

I claim:

1. In a sorting table arrangement, a substantially circular table top member, a substantially quadrilateral table top member, a unitary table base supporting said circular table top member and said quardrilateral table top member in cooperation with each other for use by a seated person on one side of said table arrangement for sorting paper-like items, said table base comprising a base platform and two spaced apart upright posts, means on the upper end of one of said posts secured to the center underside of said circular table top member for rotatively carrying said circular table top member in a horizontal plane above the lap of said seated person, means on the upper end of the other of said posts secured to the underside of said quadrilateral table top member for fixedly carrying said quadrilateral table top member in a horizontal plane above the lap of said seated person ad spaced below the horizontal plane of said circular table top member, one edge of said quadrilateral table top member disposed beneath said circular table top member on a chord of the circle of said circular table top member, a second edge of said quadrilateral table top member disposed opposite to and substantially parallel to said first edge, a third edge of said quadrilateral table top member on said one side of said table arrangement and extending substantially between one end of each of said first and second edges and disposed substantially along a line parallel to a radius of said circle of said circular table top member, a fourth edge of said quadrilateral table top member extending substantially between the other end of each of said first and second edges, a plurality of paper sorting dividers pivotally secured at one end of each thereof to the upper side of said circular table top member, and said dividers being disposed in a partially overlapping relationship in a ring disposed concentrically to and radially inwardly of the edge of said circular table top member.

2. In a sorting table arrangement as defined in claim 1, wherein when viewed from the top of said circular table top member the direction of overlap of said dividers is such that said one end of each divider is disposed clockwise from the other free end thereof and said third edge of said quadrilateral table top member is disposed clockwise of said fourth edge thereof.

3. In a sorting table arrangement as defined in claim 1, wherein said first and second edges of said quadrilateral table top member are substantially perpendicular to a line interesecting the vertical axes of said two spaced apart upright posts.

4. In a sorting table arrangement as defined in claim 1, wherein said fourth edge of said quadrilateral table top menber is disposed along a line substantially perpendicular to said first and second edges.

5. In a sorting table arrangement as defined in claim 1, wherein said means on the upper end of the other of said posts secured to the underside of said quadrilateral table top member for fixedly carrying said quadrilateral table top member is manually operable to enable said quadrilateral table top member to be rotated in said horizontal plane about the vertical axis of said other of said posts to fixedly secure said third edge in a limited range on each side of said line parallel to a radius of the circle of said circular table top member.

6. In a sorting table arrangement as defined in claim 1, wherein said base platform comprises at least two floor engaging substantially horizontal leg members, one of said leg members disposed substantially beneath said quadrilateral table member parallel to said first and second edges thereto and terminating horizontally within said third edge, the other of said leg members disposed substantially beneath said circular table top member parallel to said first leg member.

7. In a sorting table arrangement as defined in claim 6, wherein said base platform further comprises an elongated member disposed in the horizontal plane of said two floor engaging leg members, the ends of said elongated member being secured to said two floor engaging leg members intermediate the ends thereof.

8. In a sorting table arrangement as defined in claim 7, and means securing the lower end of said other of said posts to the upper side of said elongated member.

9. In a sorting table arrangement as defined in claim 8, and means securing the lower end of said one of said posts to the upper side of said elongated member.

10. In a sorting table arrangement as defined in claim 9, wherein each of said means securing the lower ends of said posts to said elongated member comprises the lower ends of said posts being tubular and tapered radially inwardly to the lower edges thereof, a complementary tapered block disposed within the lower tubular tapered end of each of said posts, the lower end of each block terminating above the lower edge of each of said posts, each of said blocks having a threaded hole therethrough lying on the vertical axes of said posts, and a bolt disposed through said elongated member from the underside thereof and threaded into the threaded holes of each of said blocks.

* * * * *